US006202863B1

(12) United States Patent
Grenier

(10) Patent No.: US 6,202,863 B1
(45) Date of Patent: Mar. 20, 2001

(54) SUCKER ROD CRADLE APPARATUS

(75) Inventor: Peter Grenier, Olds (CA)

(73) Assignee: G & P Enterprises, Ltd. (CA)

( * ) Notice: Subject to any disclaimer, the term of this patent is extended or adjusted under 35 U.S.C. 154(b) by 0 days.

(21) Appl. No.: 09/038,580

(22) Filed: Mar. 11, 1998

(30) Foreign Application Priority Data

Mar. 11, 1997 (CA) ..... 2199653

(51) Int. Cl.[7] ..... E21B 19/14
(52) U.S. Cl. ..... 211/70.4; 414/22.62
(58) Field of Search ..... 211/70.4, 49.1, 211/60.1, 184, 191; 414/22.51, 22.62, 745.1, 608, 923, 924

(56) References Cited

U.S. PATENT DOCUMENTS

| | | | | |
|---|---|---|---|---|
| 2,459,627 | * | 1/1949 | Cox | 211/70.4 |
| 2,703,178 | * | 3/1955 | Corn | 211/70.4 |
| 3,365,085 | * | 1/1968 | Wilson | 214/80 X |
| 3,400,828 | * | 9/1968 | May | 211/70.4 |
| 3,452,887 | * | 7/1969 | Larson et al. | 214/80 |
| 3,537,599 | * | 11/1970 | Jay | 211/60.1 |
| 3,563,392 | * | 2/1971 | Frias | 211/70.4 |
| 3,581,907 | * | 6/1971 | Schmidt | 211/60.1 |
| 3,870,165 | * | 3/1975 | Besijn | 211/70.4 |
| 3,945,497 | * | 3/1976 | Greenberg | 211/60.1 |
| 4,380,297 | * | 4/1983 | Frias | 211/70.4 |
| 4,725,179 | * | 2/1988 | Woolslayer et al. | 211/70.4 |
| 4,729,537 | * | 3/1988 | Turner et al. | 211/70.4 |
| 4,787,788 | * | 11/1988 | Versteeg | 211/70.4 |
| 5,188,503 | * | 2/1993 | Appelberg | 414/745.1 |
| 5,411,360 | * | 5/1995 | Hilliker et al. | 414/608 |
| 5,476,282 | * | 12/1995 | Dahl | 280/651 |
| 5,798,636 | * | 8/1998 | Vogel | 211/184 X |

* cited by examiner

*Primary Examiner*—Daniel P. Stodola
*Assistant Examiner*—Jennifer E. Novosad
(74) *Attorney, Agent, or Firm*—Young & Basile, P.C.

(57) ABSTRACT

A sucker rod cradle for storage, handling and transportation of sucker rods comprises in combination a base frame having forklift pockets, a plurality of upright cradle arms spaced along the base frame and extending perpendicular to the base frame. The cradle arms having channels to receive ends of spacers for stacks of sucker rods. The cradle arms may also receive ends of bundle spacers to permit transport of bundles of multiple rods. The base frame may be made up of spaced apart beams interconnected by cross members. The ends of the base frame may also include U-shaped bars to provide for crane lifting of the sucker rod cradle. The base frame may also include drip pans to contain contaminants dripping from the bundles of sucker rods. The cradle apparatus provides a very convenient system for storage, transport and on sight handling of sucker rods used in oil field facilities.

20 Claims, 12 Drawing Sheets

Figure 5
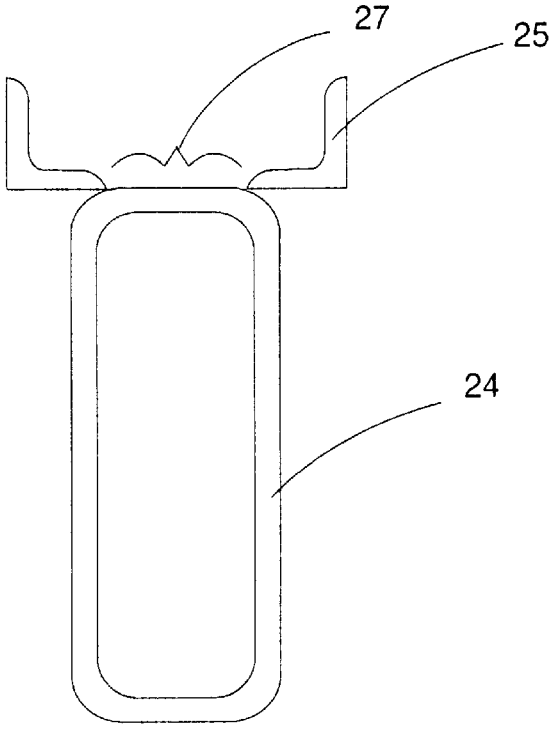
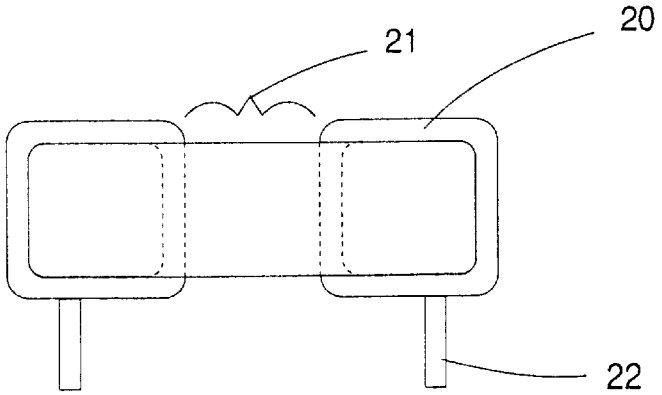
Figure 6

SUCKER ROD CRADLE APPARATUS

FIELD OF THE INVENTION

This invention relates in general to sucker rods used in oil well recovery and more particularly to a sucker rod cradle apparatus for handling, storing and transporting sucker rods.

BACKGROUND OF THE INVENTION

Sucker rods are typically used in oil well pumping operations to stroke or drive the pump located near the bottom of the well bore and subsequently facilitate the withdrawal of oil from the production zone or reservoir. Several such rods must be coupled together to form a sucker rod string and therefore, dependent on the depth, large numbers of such rods must be handled, stored and transported to various oil well sites on a regular basis. A common method for the handling, storage and transporting of sucker rods comprises layering and stacking the sucker rods between wooden boards approximately 2.5" wide by 30" in length with each board having grooves to space and hold a capacity of 15 rods. The boards are spaced at five standardized increments along the length of a sucker rod which is typically 25 feet. Subsequent layers or tiers of 15 rods each are then added by using another five boards along the length of the rod directly above the lower five boards. A typical bundle of 60 sucker rods comprising four layers or tiers of 15 rods each is produced in this manner. The final step is the addition of a fifth top board to each column of boards in such a manner that the 15 grooves fit into the top tier of rods. The five columns of five boards each are then strapped together using steel banding.

While such a method is widely used for bundling, handling, storing and transporting sucker rods, bundling the rods in this manner does little to protect the sucker rods from damage. The ends of the sucker rods have no protection other than to the threaded areas, which have thread protectors, and are particularly prone to bending because of their projection through the end of the bundle. Furthermore, this method is labor intensive, requires specialty equipment is required to move, load or unload the sucker rods and does not provide a means to contain contaminants which drip off any used rods being removed from the well.

Another method for bundling, handling, storing and transporting sucker rods is without the use of any type of spacers. In this method 25 to 50 plain rods are simply bundled together. This method does not work well if guides or scrapers have been molded onto the rod body. Although this method minimizes the potential of bending a plain rod, it is also prone to the same problems and disadvantages encountered by the banding method employing wooden boards as described previously. In addition, the metal to metal contact between the sucker rods themselves can cause damage.

It is therefore an object of an aspect of the present invention to obviate or mitigate at least one of the aforesaid disadvantages that are associated with the currently known and used methods for handling, storing and transporting any new, used or reconditioned sucker rods.

SUMMARY OF THE INVENTION

According to the present invention a novel apparatus has been developed for the handling, storage and transporting of sucker rods. The apparatus overcomes the disadvantages of the previously used methods for bundling, handling, storing and transporting sucker rods. The present apparatus significantly enhances the protection of all sucker rods placed within from damage and also provides a level of contamination containment far greater than is currently being practised by the oil industry in general when removing used rods from a well. Although the apparatus of the present invention allows for the use of steel banding to make individual bundles of rods, it is not necessary to band the rods. As a result the apparatus makes it possible to store, add or remove and transport sucker rods without the need to unbundle or rebundle any rods. This significantly reduces the amount of labour and related costs currently required to handle the rods.

According to an aspect of the present invention a sucker rod cradle is provided for the storage, handling and transportation of rods, the apparatus comprises in combination:

- a base frame having a pocket means for engagement with corresponding fork means of a forklift;
- a plurality of upright cradle arms spaced at intervals along the length of the base frame, the cradle arms extending substantially perpendicular to the base frame to contain rods stacked therein, and
- the cradle arms having means for receiving the ends of corresponding spacer means for spacing rods.

BRIEF DESCRIPTION OF THE DRAWINGS

A detailed description of the preferred embodiments are provided herein below with reference to the following drawings, in which:

FIG. 5 is a vertical sectional view of the interconnecting beam and the cradle arm base pocket in accordance with the preferred embodiment of the present invention;

FIG. 6 is a horizontal sectional view of a cradle arm in accordance with the preferred embodiment of the present invention;

Figure 1:
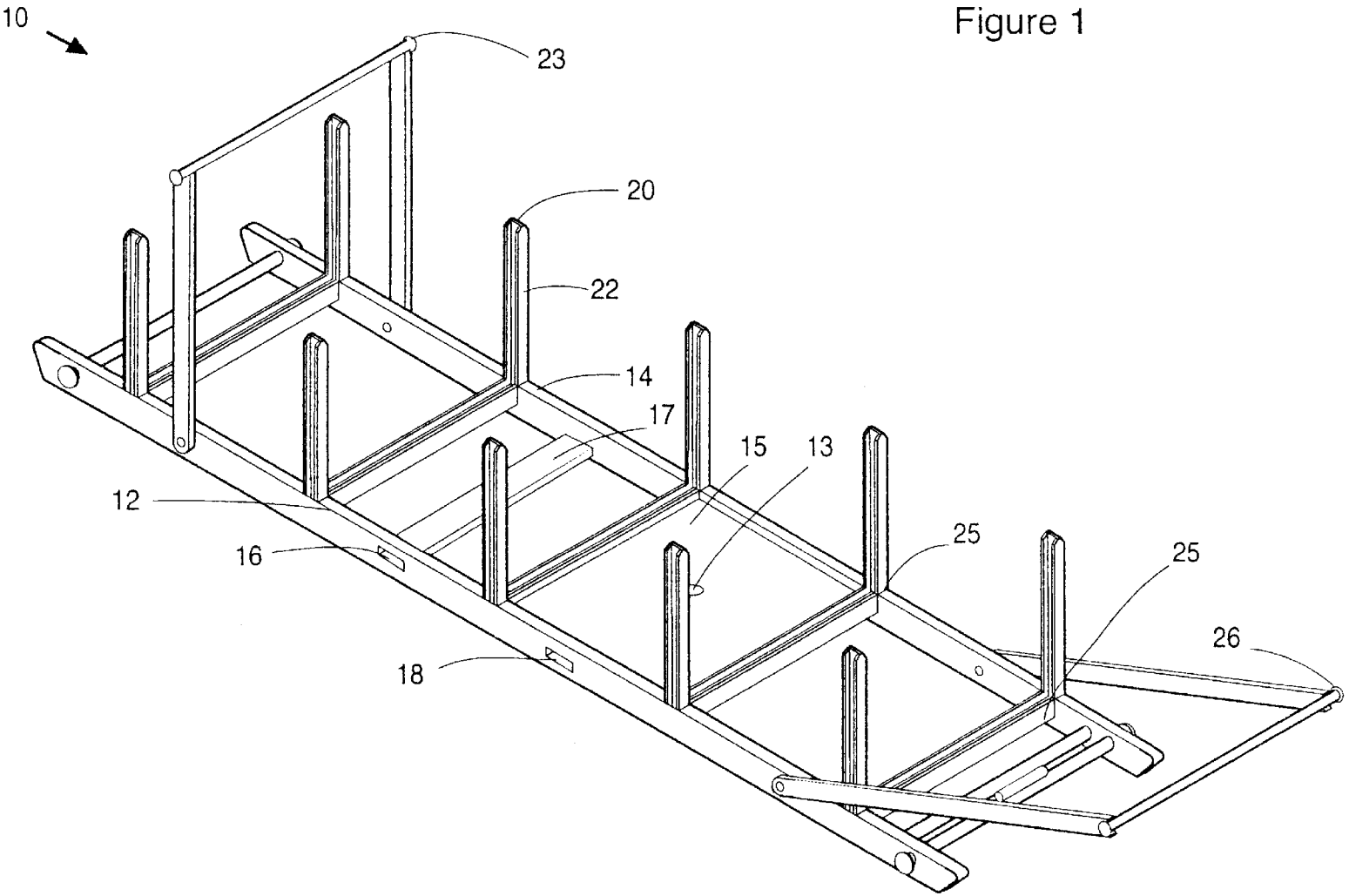
FIG. 1 is a perspective view showing a sucker rod cradle apparatus in accordance with the preferred embodiment of the present invention.

In The drawings, preferred embodiments of the invention are illustrated by way of example. It is to be expressly understood that the description and drawings are only for the purpose of illustration and as an aid to understanding and are not intended as a definition of the limits of the invention.

DETAILED DESCRIPTION OF THE PREFERRED EMBODIMENTS

Figure 2:
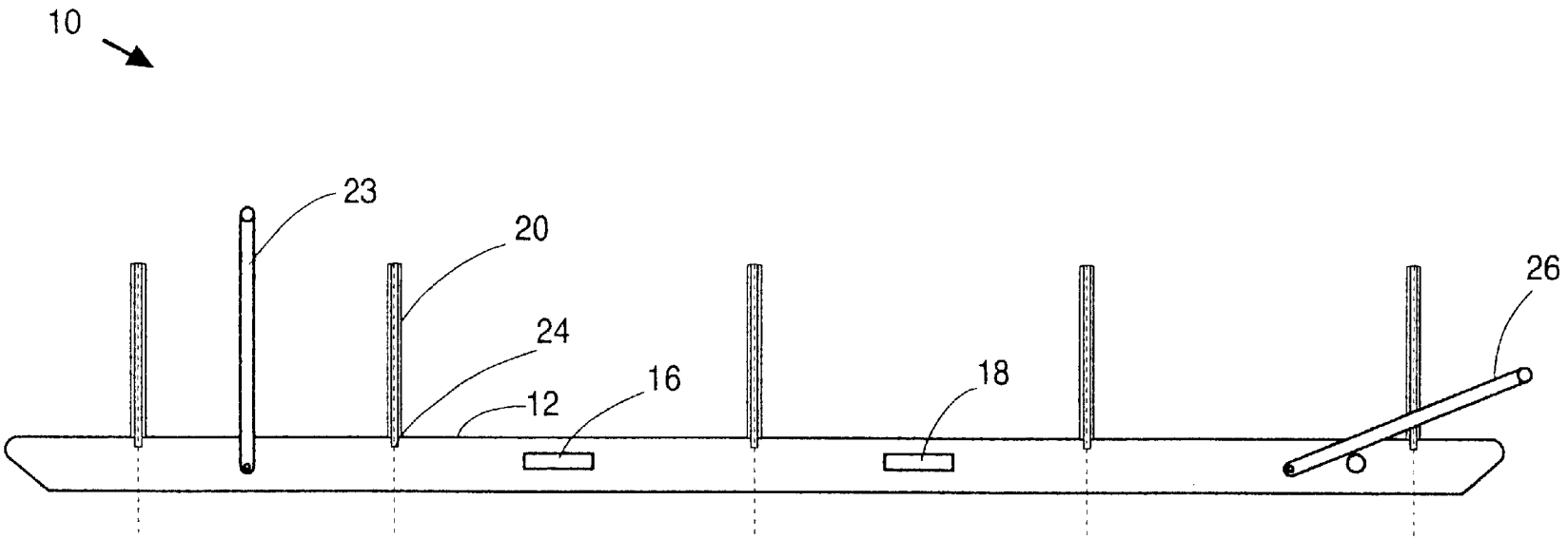
FIG. 2 is a side elevational view of the apparatus in accordance with the preferred embodiment of the present invention.

The sucker rod cradle apparatus 10 according to the present invention is shown in FIGS. 1 and 2. The apparatus comprises a base frame which in accordance with this particular embodiment has spaced apart parallel beams 12 and 14, interconnected by a plurality of cross members 24. It is appreciated that the base frame may be constructed in other ways to provide a base or platform on which the rods are stacked. The base frame may be slightly longer than the length of the sucker rods, this being approximately 25 feet. The base frame, in particular, the spaced apart beams 12 and 14 preferably have aligned pairs of pockets 16 and 18 within inverted channels 17 and 19. In this view the drip pans 15 are removed except for the one covering channel 19. These pockets 16 and 18 are designed to engage with corresponding forks on a fork lift and provide a quick and easy method of handling and moving the cradle.

The apparatus has a plurality of upright cradle arms 20 spaced at substantially regular intervals along the length of and connected to the base frame. The cradle arms 20 extend perpendicular from the beams 12 and 14 preferably at the cross members 24, and are designed to contain the vertical columns of sucker rods spacers 30 and optional bundle spacers 28 of FIGS. 13 and 14. The cradle arms 20 have opposing channels 22 for receiving the ends of corresponding sucker rod spacers 30 and optional bundle spacers 28. The channels allow one to slide the spacers down through the opposing members and capture the spacer ends as rods are placed thereon. This arrangement is described in more detail with regard to FIG. 15.

Figure 3:
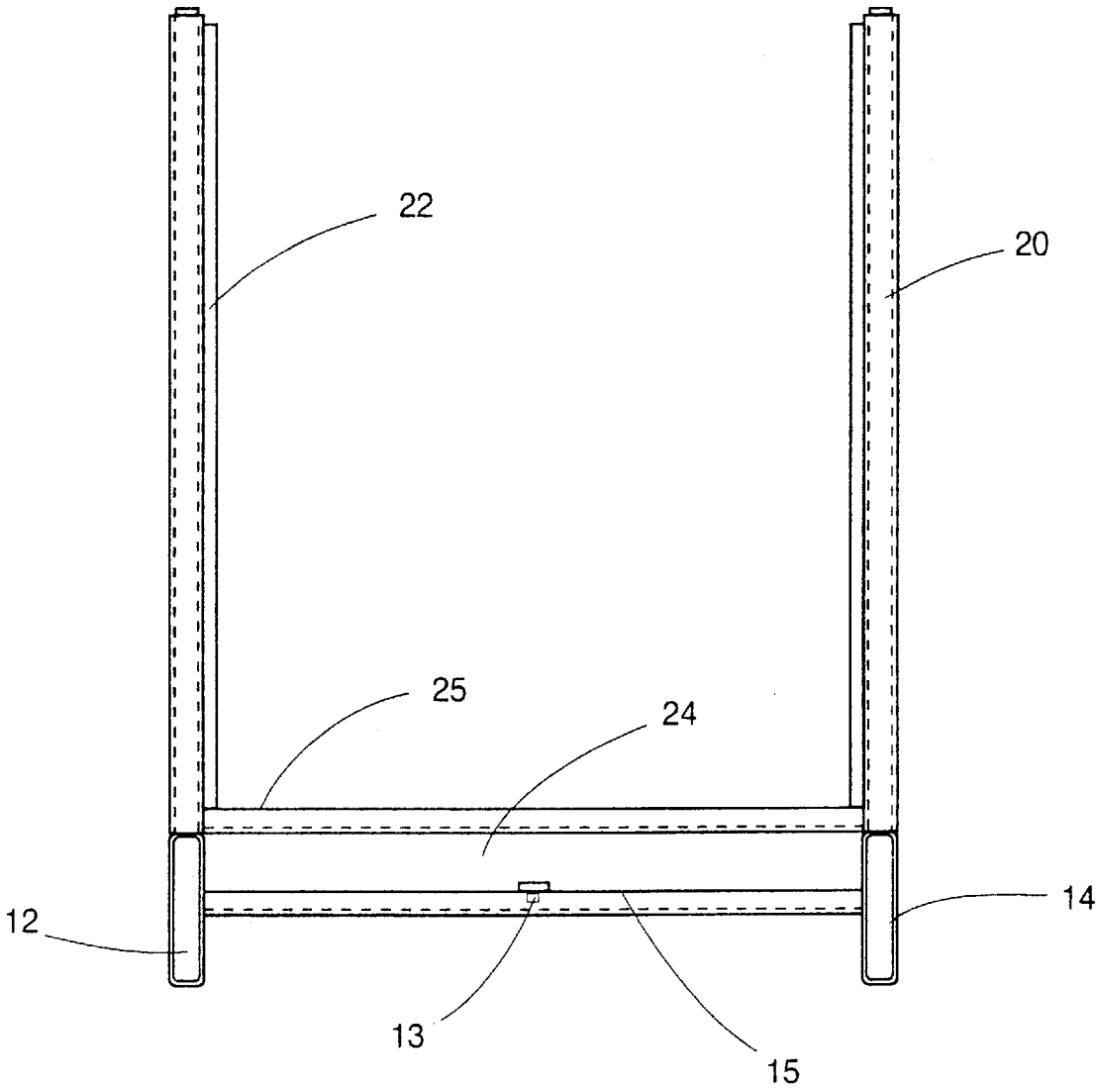
FIG. 3 is an vertical sectional view of the cradle arms, base frame and drip pan profile in accordance with the preferred embodiment of the present invention.

As seen in FIG. 3, the vertical cradle arms 20 have a horizontal reinforcing base member 24, a plurality of vertically opposing channel members 22, and a plurality of horizontally opposing channel members 25 on top of which and within which the first rod spacer and subsequently the first layer or tier of sucker rods is placed. The horizontal base members 24 are located between and preferably welded to beams 12 and 14. The horizontally opposing channel members 25 are located at the base of, between and adjacent to the vertical cradle arms 20 and directly below the vertically opposing channels 22 forming the base pocket. In addition a drip pan 15, as also shown in FIG. 1, is located in a recessed position between and adjacent beams 12 and 14 and within each segmented length created by the plurality of horizontal base members 24. The pan has a plugged drain hole 13.

As shown in FIG. 1, the drip pan 15 is recessed between and along the length of beams 12 and 14 and acts to help contain any contaminating material that may drip from used rods when placed in the cradle apparatus. Such contaminating materials include but are not limited to oil and oil derivatives. The drip pans 15 can be of various widths and lengths in order to be mounted to the cradle apparatus. It is understood by those skilled in the art, that several drip pans in succession can be positioned between arms 20 along the entire length of the cradle apparatus. Alternatively, a single elongated drip pan can be mounted to the cradle apparatus. Each pan has a plugged drain hole 13 shown also in FIG. 3 to permit draining of any liquid contaminants into a suitable reservoir.

Figure 4A:
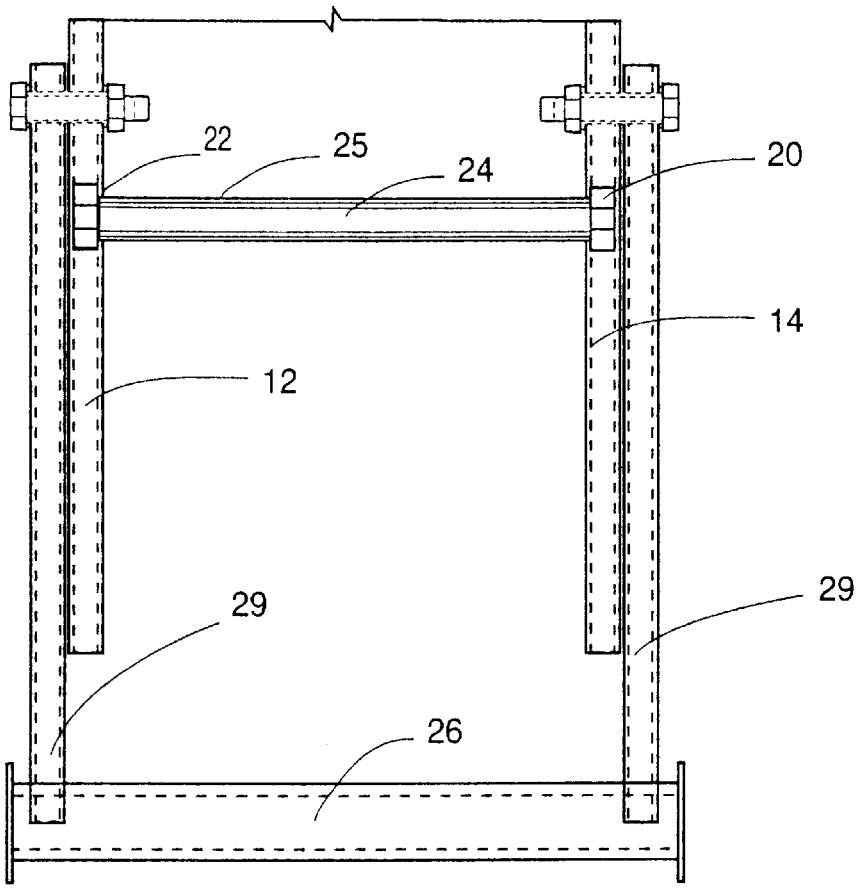
FIGS. 4A and B are horizontal and vertical sectional views of the lifting bars in accordance with a preferred embodiment of the present invention.
Figure 4B:
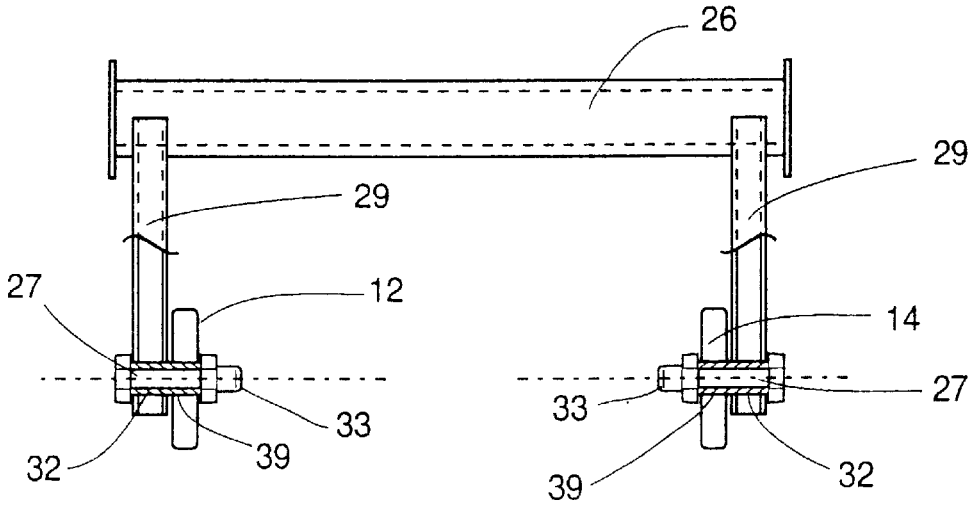

As seen in FIGS. 4A and B, the pivoting U-shaped lifting arms 23 or 26 is mounted through and to the outside of beams 12 and 14 to permit in the alternative, moving the cradle with a crane. Each respective lifting bars 23 and 26 can rotate toward the center of the cradle apparatus in order to be easily attached to a crane or picker using relatively short cables or slings. The pivoting lifting bars 23 and 26 can also rotate out, over and past the ends of the cradle apparatus in order to facilitate the placement of, or removal of sucker rods and in this position provide additional protection to the ends of the rods. Each dependent arm 29 of the U-shaped lifting bars is anchored pivotally to The beams 12 and 14 by pins 27 which pass through independent sleeves 32 and 39 permanently fastened within their respective members. Each pin 27 is then held in place using a nut, bolt and washer assembly 33.

As seen in FIG. 5, the horizontal reinforcing base member 24 has horizontally opposing channel members 25 in which the first sucker rod spacer 30 is placed. The horizontally opposing channels 25 can accommodate banding (if desired) by passing the banding beneath the spacer 30 and through the depressed portion or banding gap 27.

FIG. 6 illustrates the banding slot 21 located between the cradle arms 20 and the opposing channels 22.

Figure 14:
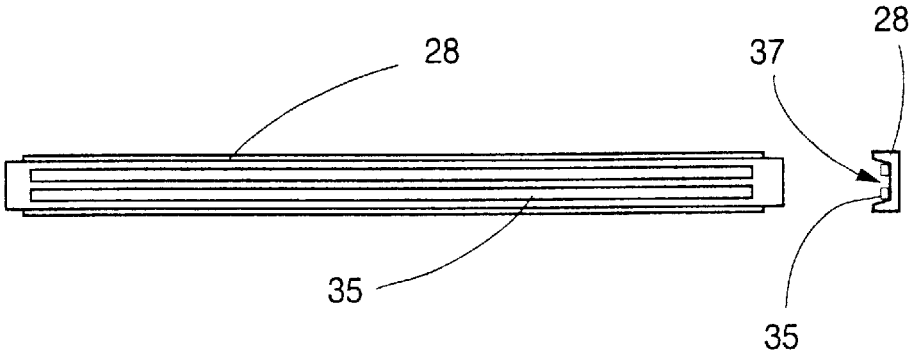
FIG. 14 is a horizontal sectional view of the bundle spacer in accordance with both the present and second embodiments of the invention.

Referring now to FIG. 14, a bundle spacer 28 is illustrated. The bundle spacer is a substantially elongated rectangular shaped member having ends which fit into the vertically opposing channels 22 on the cradle arms 20. The bundle spacer 28 also includes flat bars 35 welded spaced apart in the base of the spacer so when sucker rod spacer is positioned in the bundle spacer 28, the flat bars 35 provide a gap through which banding may pass when fabricating a bundle. These bundle spacer can be used to separate an appropriate number of tiers of sucker rods if desired. The number of tiers of rods being typically twelve to sixteen as capacity for each cradle.

Figure 13:
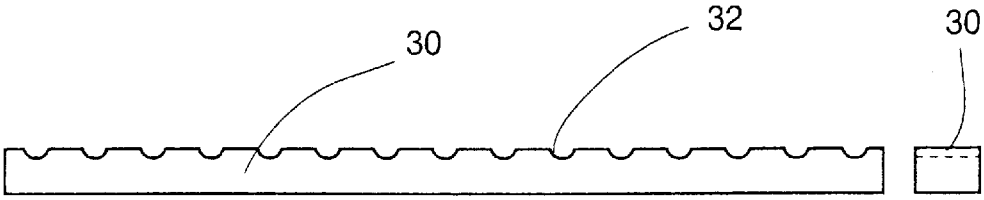
FIG. 13 is a side elevational view of the sucker rod spacer in accordance with both the first and second embodiments of the invention.

FIG. 13 shows a sucker rod spacer 30 which is also elongated and rectangular and designed to fit within the vertically opposing channels 22 of the cradle arms 20 and as well in the base of the bundle spacer 28. The sucker rod spacer 30 has a plurality of grooves 32 along one longitudinal surface in which the sucker rods are set resulting in even placement and spacing so that the sucker rods are independently spaced and therefore do not touch each other. In this manner they are not damaged. Preferably, the sucker rod spacer has 15 grooves in which an equivalent number of sucker rods can be placed. However, it is understood by those skilled in the art that the sucker rod spacer can be made with larger diameter or smaller diameter grooves to accommodate a fewer or a greater number of rods per tier.

Figure 7:
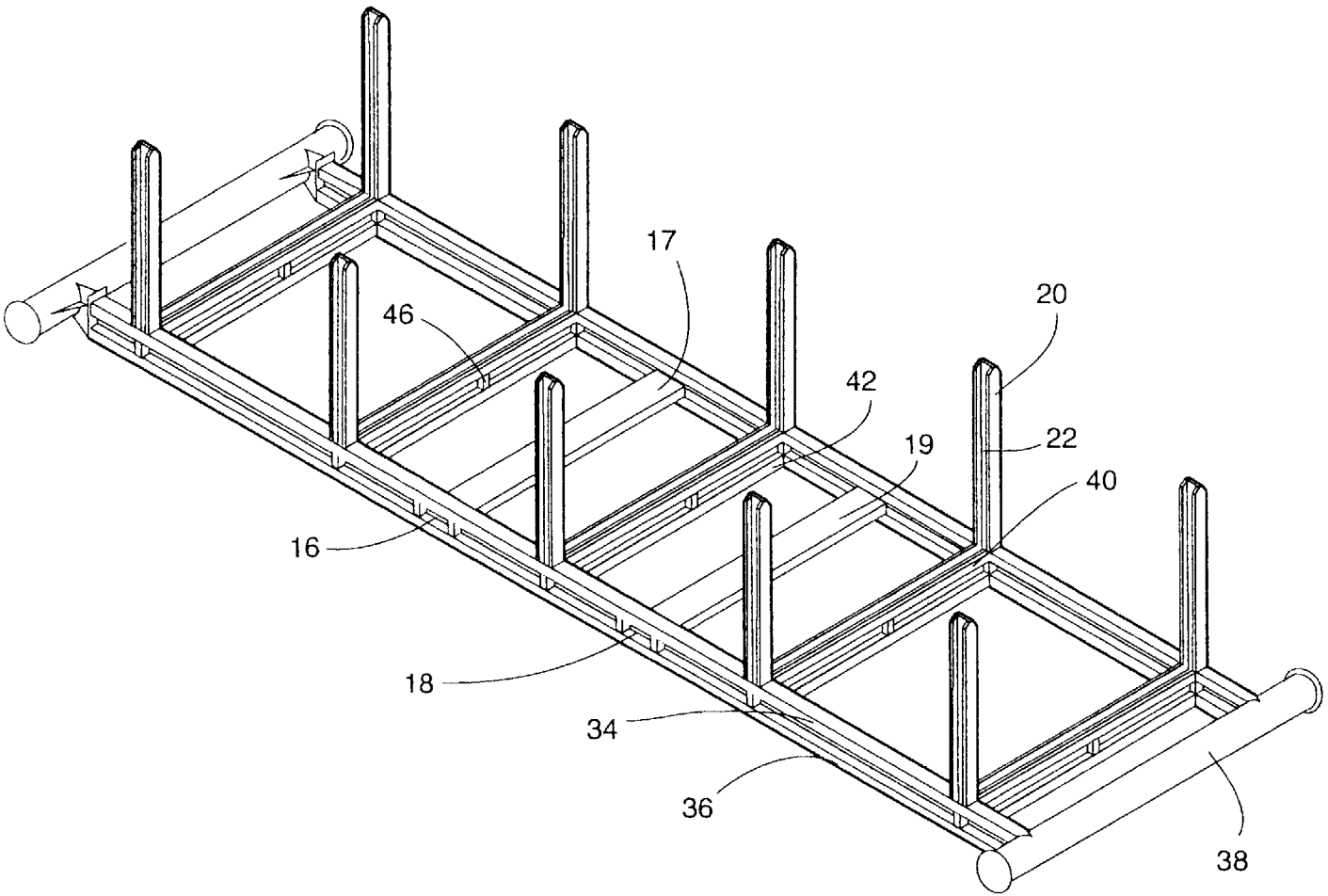
FIG. 7 is a perspective view showing a sucker rod cradle apparatus in accordance with the second embodiment of the invention.
Figure 8A:
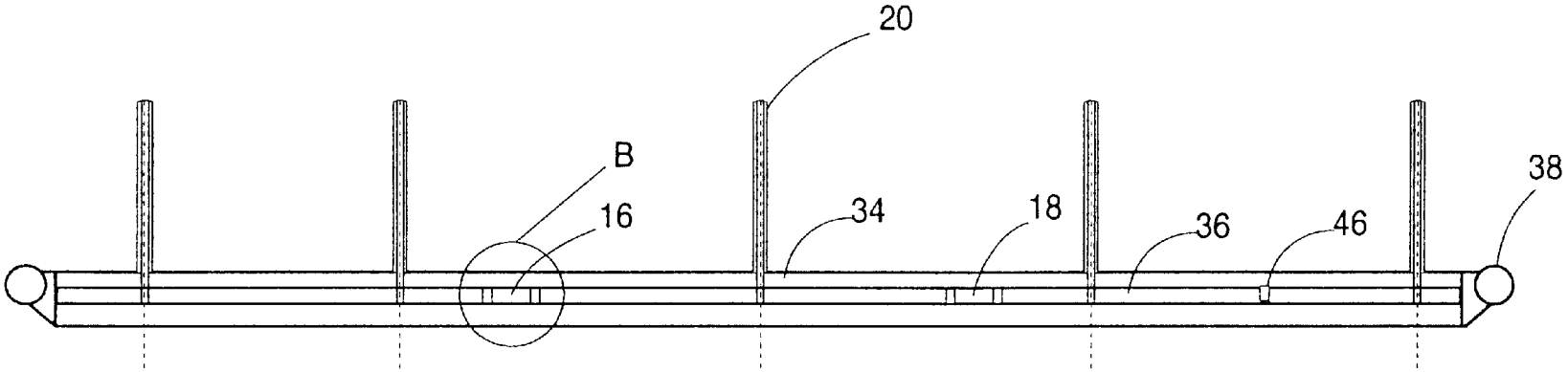
FIG. 8A is a side elevational view and derail of the apparatus in accordance with The second embodiment of the invention.
Figure 8B:
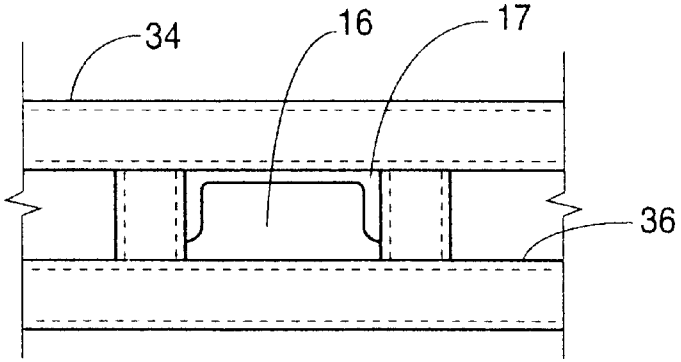
FIG. 8B is a detail side view of the fork lift pockets.

A second embodiment of the invention is shown in FIG. 7. In this embodiment the base frame has beams made from interconnected spaced apart members 34 and 36 as shown again in FIG. 8A. The spaced apart members 34 and 36 have aligned pairs of pockets 16 and 18 within inverted channels 17 and 19 as detailed in FIG. 8B.

Figure 9:
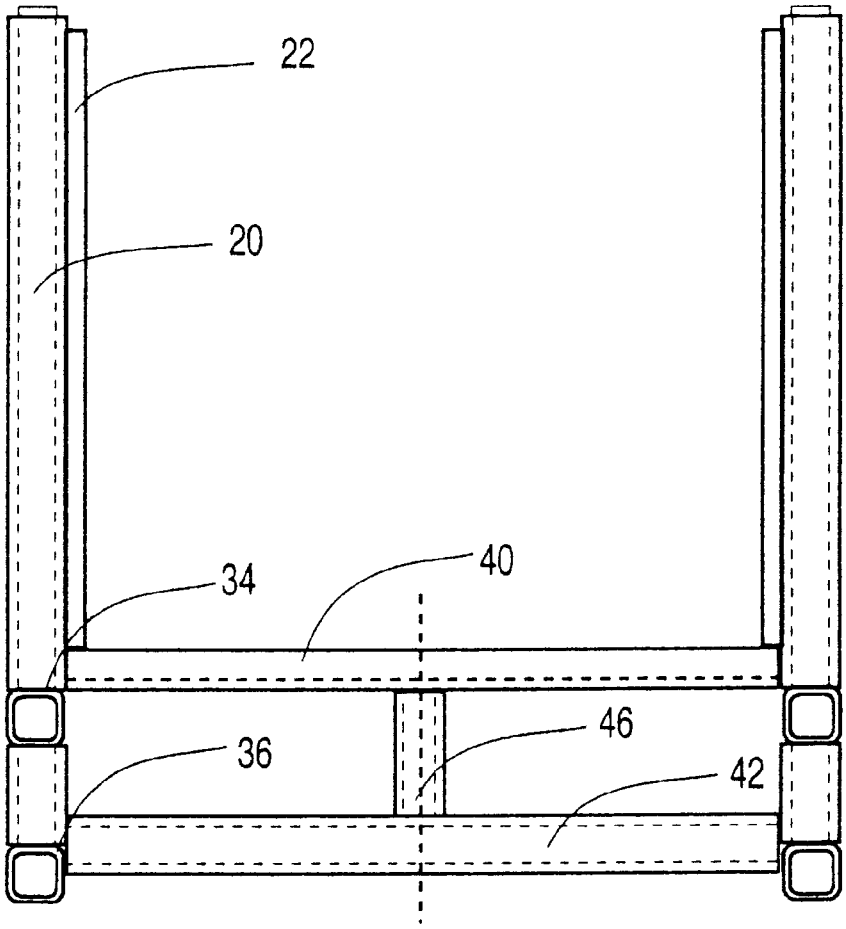
FIG. 9 is a vertical sectional view of the cradle arms and base frame in accordance with the second embodiment of the invention.

As seen in FIG. 9, The cradle arms 20 have a pair of spaced apart horizontal reinforcing base members 40 and 42 on top of which the first sucker rod spacer and subsequent first tier of sucker rods is placed. These spaced apart horizontal reinforcing base members are themselves reinforced with a vertical spacer member 46 located substantially at the center of base members 40 and 42.

Figure 10A:
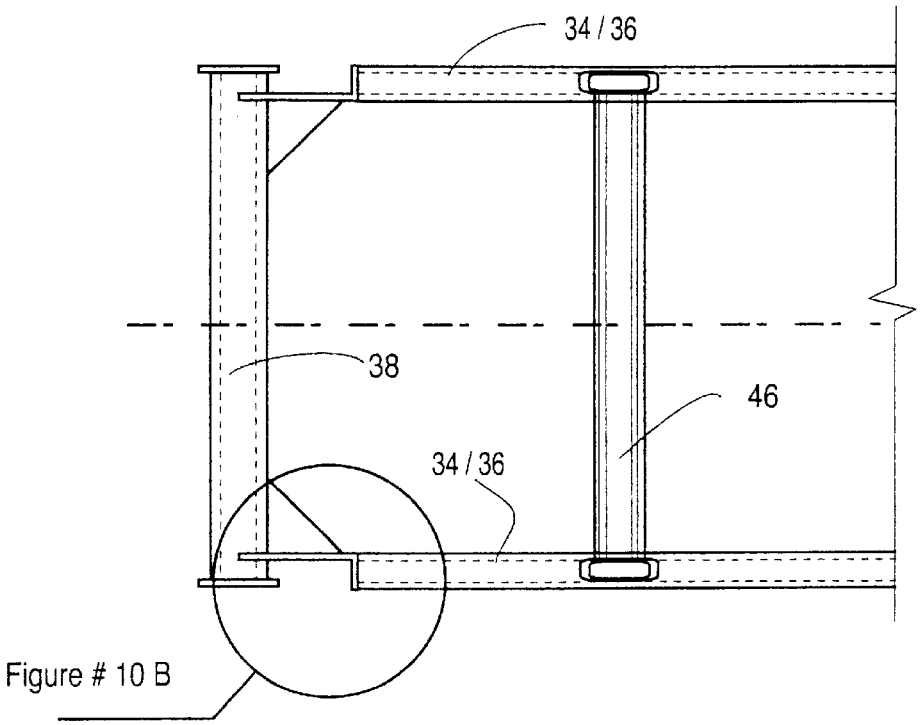
FIG. 10A is a horizontal sectional view and detail of the loading apparatus in accordance with the second embodiment of the invention.
Figure 10B:
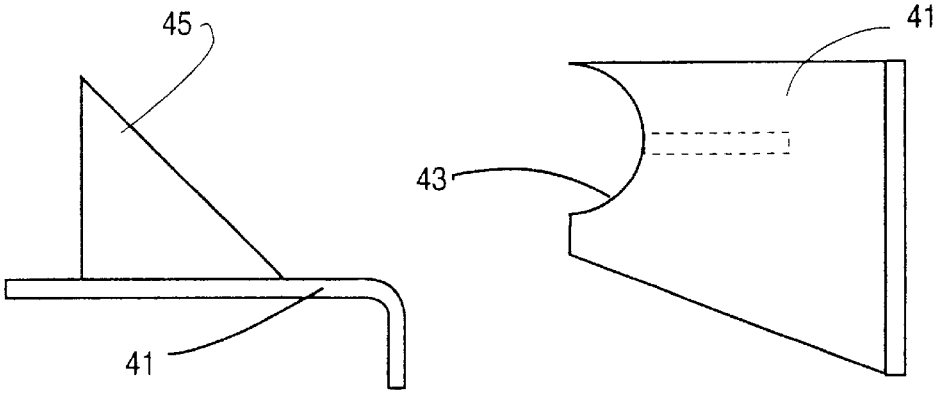
FIG. 10B is a side elevational view of a bracket as used in the apparatus of FIG. 10A.

As seen in FIG. 10A, there are no pivoting arms mounted on the outside of the beams 34 and 36. Instead, the ends of the beams 34 and 36 are integral and connected by a bracket 41 as per FIG. 10B to a horizontal bar 38 onto which a lifting apparatus such as a winch line can be attached. The bracket 41 has a rounded recess 43 and brace 45 welded to bar 38 to complete the connection. The horizontal bar projects beyond the rod ends to protect the ends of the sucker rods stacked within the apparatus.

Figure 11:
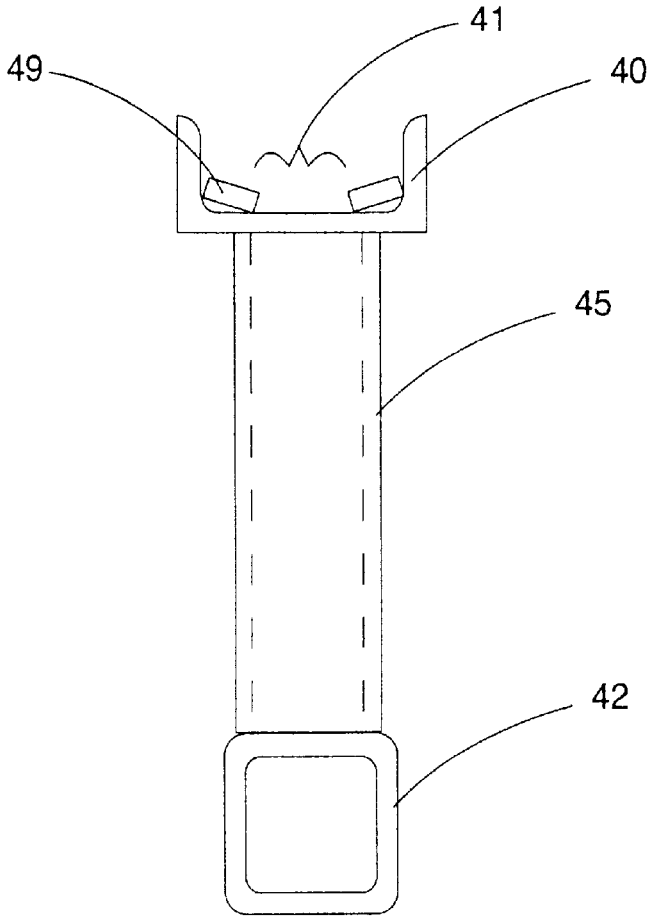
FIG. 11 is a vertical sectional view of the interconnecting beam and the cradle arm base pocket in accordance with the second embodiment of the invention.

As seen in FIG. 11 the horizontal reinforcing base member 40 is an upright channel member in which the first sucker rod spacer 30 is inserted. The upright channel accommodates banding (if desired) by passing the banding beneath the spacer 30 and through opening 41 defined by spaced apart flat bar 49.

Figure 12:
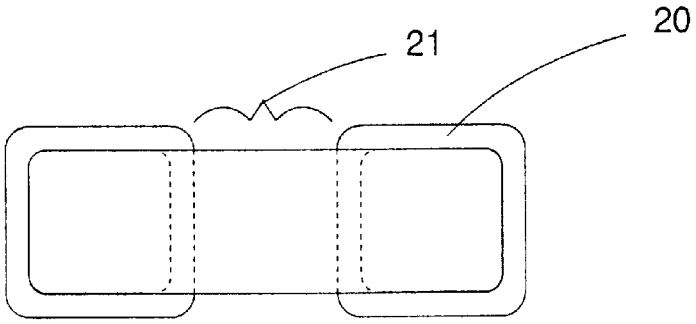
FIG. 12 is a horizontal sectional view of a cradle arm in accordance with the second embodiment of the invention.

FIG. 12 illustrates the banding slot 21 contained within the cradle arm 20 of the second embodiment.

Figure 15:
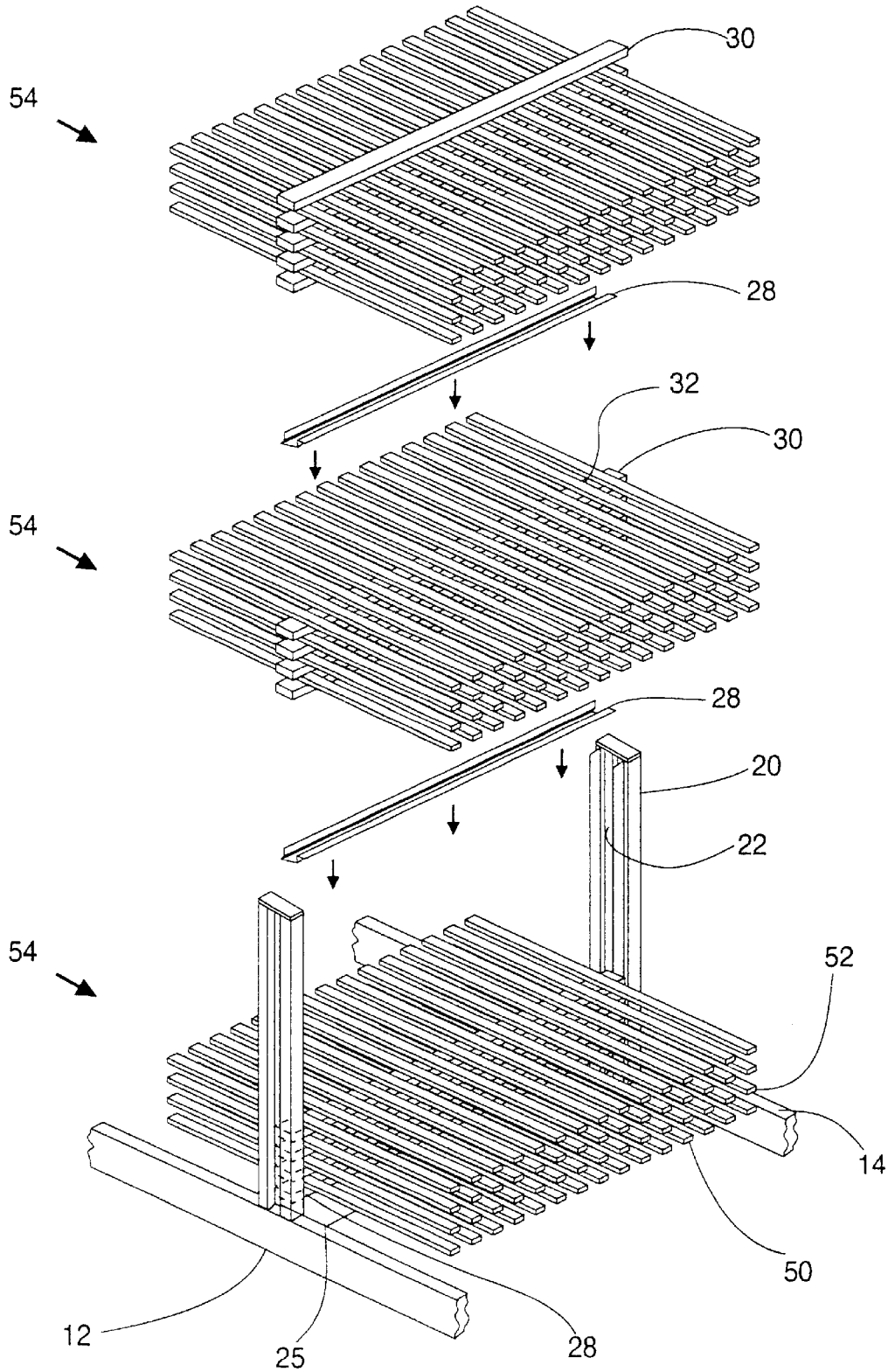
FIG. 15 is a partial perspective view of rods stored in the cradle.

In operation and with reference to FIG. 15, a first layer of sucker rods rest on spacer 30 with grooves 32 facing up, are positioned one into each of the five base pockets on top of each cross member 25 and between the vertical channels 22 created by the cradle arms incrementally positioned along the entire length of the beams. A fist layer 50 or tier comprising fifteen sucker rods in total is placed into the grooves of each of the five sucker rod spacers 30. Another layer of sucker rod spacers 30, also with the grooves 32 facing up, are then positioned between the channels 22 of the cradle arms 20 on top of the first tier of rods. A second layer 52 or tier of sucker rods is then set into the grooves of the second layer of sucker rod spacers 30. This process is repeated until the cradle reaches its capacity of 180 to 240 sucker rods. If desired optional bundle spacers 28 may be inserted after the completion of every fourth layer or tier of sucker rods in a similar fashion as the sucker rod spacers so as to facilitate the capability of bundling. A total of three to four bundles 54 comprising 60 sucker rods each can be placed within the cradle arms.

Although the apparatus of the present invention is designed to stack and hold approximately 180 to 240 rods, it is understood by those skilled in the art that the apparatus can be made larger or smaller to accommodate a fewer or greater number of rods or accommodate shorter or longer types of rods. It is also understood by those skilled in the art that the apparatus can hold a variety of rods including plain, coated, guided or tapered rods all with the same efficiency, ease and protection.

The apparatus can be made of any type of metal or metal alloy. It is preferred that the apparatus be made of steel or similar material. The beams, cradle arms, lifting arms and all of the other elements of the apparatus are preferably welded together in order for the apparatus to be strong and sturdy.

In summary, the novel sucker rod cradle apparatus of the present invention is considered to be in accordance with the recommendations and specifications contained in the American Petroleum Institutes manuals A.P.I. 11-B and 11-BR for the care and handling of oilfield sucker rods and should therefore be considered as a unique device for handling, storing and transporting sucker rods. The design of the apparatus provides protection to both the sucker rods and the environment, from damage and contamination respectively, and has the engineered capacity to hold and transport at one time up to four times the normal number of rods without the risk of damage to any rods. In addition, the apparatus has built-in methods by which it can be moved, loaded or unloaded, thus eliminating the need for additional specialized handling equipment This unique apparatus eliminates the need to bundle rods which in turn makes the handling of the rods easier, faster and more cost efficient. The apparatus however does, if required, allow for the creation of bundles all of which will be to the same standard spacing and dimensions. As a result any bundles of rods removed from the apparatus will be stackable in the preferred "board on board"method when stacking bundles.

While embodiments of the present invention have been illustrated and described in detail it will be evident to those skilled in the art that variations and modifications may be made therein without departing from the spirit or scope of the invention or the claims appended hereto.

What is claimed is:

1. A sucker rod cradle apparatus for the storage, handling and transportation of rods, the apparatus comprising in combination:

a base frame comprising a pocket means for engagement by corresponding fork means of a forklift for handling and moving of said cradle apparatus;

a plurality of paired upright cradle arms spaced at intervals on opposed sides along the length of the base frame, the cradle arms extending substantially perpendicular to the base frame rods stacked therein;

wherein each pair of upright cradle arms has continuous elongate vertical channels open towards each other for receiving sucker rod spacer means to individually space and layer the rods and to receive bundle spacer means for spacing bundles of rods.

2. The apparatus of claim 1, wherein said base frame comprises parallel spaced apart interconnected beams, the beams having said pocket means.

3. The apparatus of claim 2 wherein said base frame additionally comprises cradle transport means pivotally attached adjacent to each end of the base frame for attachment of a lifting apparatus.

4. The apparatus as claimed in claim 3, wherein said cradle transport means comprises U-shaped arms pivotally mounted to an outside portion of the parallel beams.

5. The apparatus as claimed in claim 4. wherein the U-shaped arms are pivotally mounted to the outside of the beams via pins.

6. The apparatus as claimed in claim 2, wherein said spaced apart interconnected beams are parallel beams interconnected by a plurality of cross members.

7. The apparatus as claimed in claim 2, wherein said pocket means comprises open compartments having inverted channels therein designed to engage with corresponding fork means of a forklift.

8. The apparatus of claim 2, wherein individual drip pans are provided in a recessed position between and adjacent the spaced apart parallel beams.

9. The apparatus as claimed in claim 1, wherein each pair of upright cradle arms are joined at their base with horizontal reinforcing base member, said reinforcing base member having horizontally opposing channels located between and adjacent the cradle arms for receiving and engaging with the rod spacer means for layering of sucker rods.

10. The apparatus as claimed in claim 9, wherein the horizontal base members are located between and welded to parallel beams.

11. The apparatus as claimed in claim 1 additionally comprising a plurality of sucker rods carried by said cradle.

12. The apparatus as claimed in claim 1, wherein said bundle spacer means comprises a substantially elongated rectangular shaped member having ends which fit within the channels on the cradle arms.

13. The apparatus as claimed in claim 12, wherein said bundle spacer means additionally comprises a pair of horizontally opposed, spaced apart flat bars attached to said spacer to provide a gap through which a banding means may be passed to band a bundle of sucker rods.

14. The apparatus as claimed in claim 12, wherein said bundle spacer means facilitates rod bundling by virtue of channel through which a bundle strap may be inserted.

15. The apparatus as claimed in claim 1, wherein said spacer means comprises as elongated body designed to engage within the continuous vertical channels of said cradle arms and a longitudinal surface having a plurality of grooves in which sucker rods are placed.

16. The apparatus as claimed in claim 15 wherein said spacer means has multiple grooves to accommodate and independently space the rods to form a tier.

17. The apparatus of claim 1, wherein means is provided in said base frame to collect contaminants dripping from rods positioned in said cradle.

18. A sucker rod cradle apparatus for storage, handling and transportation of rods, the apparatus comprising;

a base frame comprising parallel spaced apart interconnected beams having pocket means in at least one of said beams for engagement with a corresponding fork of a lift truck for handling and moving of said cradle apparatus;

a plurality of paired upright cradle arms spaced at intervals on opposed sides along the length of the base frame, each pair of upright cradle arms has continuous elongate vertical channels open towards each other to receive sucker rod spacer means to individually space and layer the rods and to receive bundle spacer means for spacing bundles of rods, the cradle arms extending substantially perpendicular to the base frame to retain rods stacked therein; and cradle transport means attached adjacent to each end of the base frame for attachment of a lifting apparatus.

19. A sucker rod cradle apparatus for storage, handling and transportation of rods, the apparatus comprising:

a base frame comprising parallel spaced apart interconnected beams;

a plurality of paired upright cradle arms spaced at intervals on opposed sides along the length of the base frame, the cradle arms extending substantially perpendicular to the base frame to retain rods stacked therein; each pair of upright cradle arms has continuous elongate vertical channels open towards each other to receive sucker rod spacer means to individually space and layer the rods and to receive bundle spacer means for spacing bundles of rods; and collection means providing in the base frame to collect contaminants dripping from rods positioned in said cradle.

20. A sucker rod cradle apparatus for the storage, handling and transportation of rods, the apparatus comprising in combination:

a base frame comprising a pocket means for engagement by corresponding fork means of a forklift for handling and moving of said cradle apparatus;

a plurality of paired upright cradle arms spaced at intervals on opposed sides along the length of the base frame, the cradle arms extending substantially perpendicular to the base frame to retain rods stacked therein;

wherein each pair of upright cradle arms has continuous elongate vertical channels open towards each other to receive sucker rod spacer means to individually space and layer the rods and to receive bundle spacer means for spacing bundles of rods, said bundle spacer means comprises a substantially elongated rectangular shaped member having ends which fit within the channels on the cradle arms, said bundle spacer means additionally comprises a pair of horizontally opposed spaced apart flat bars attached to said spacer to provide a gap through which a banding means may be passed to band a bundle of sucker rods.

* * * * *